US005636475A

United States Patent [19]

Nidelkoff

[11] Patent Number: 5,636,475

[45] Date of Patent: Jun. 10, 1997

[54] STRUCTURAL LOCK FOR TILTING-TYPE DOUBLE HUNG WINDOWS

[75] Inventor: Mike J. Nidelkoff, Oakdale, Minn.

[73] Assignee: Intek Weatherseal Products Inc., Hastings, Minn.

[21] Appl. No.: 551,037

[22] Filed: Oct. 31, 1995

Related U.S. Application Data

[63] Continuation of Ser. No. 164,369, Dec. 9, 1993, abandoned.

[51] Int. Cl.[6] ..... E05D 15/22

[52] U.S. Cl. ..... 49/178; 49/184

[58] Field of Search ..... 49/183, 184, 185, 49/186, 174, 175, 176, 178; 292/137, DIG. 7, DIG. 20

[56] References Cited

U.S. PATENT DOCUMENTS

| | | | |
|---|---|---|---|
| 1,120,186 | 12/1914 | Eshbach . | |
| 1,991,840 | 2/1935 | Burns | 49/183 |
| 2,078,506 | 4/1937 | Nuebel | 49/184 |
| 2,078,572 | 4/1937 | Jacob | 292/DIG. 20 |
| 2,670,982 | 3/1954 | Banham . | |
| 2,714,033 | 7/1955 | Lewgowd | 292/DIG. 20 |
| 2,731,684 | 1/1956 | Ruchin | 49/183 |
| 2,931,676 | 4/1960 | Wroughton | 292/DIG. 20 |
| 3,399,490 | 9/1968 | Hettinger . | |
| 3,445,964 | 5/1969 | Foster | 49/183 |
| 4,521,991 | 6/1985 | Sayer et al. . | |
| 4,525,952 | 7/1985 | Cunningham et al. | 49/181 |
| 4,624,073 | 11/1986 | Randall | 49/185 |
| 4,961,286 | 10/1990 | Bezubic | 49/185 |
| 5,165,737 | 11/1992 | Riegelman | 49/176 |

*Primary Examiner*—Michael J. Milano

*Attorney, Agent, or Firm*—Merchant, Gould, Smith, Edell, Welter & Schmidt, P.A.

[57] ABSTRACT

A lock mechanism for a tilting-type double hung window which is automatically brought into engagement when the window sash is in the closed position and disengagement when the window sash is opened. The locking mechanism prevents pivoting of the window sash when the window sash is in the closed position.

21 Claims, 3 Drawing Sheets

STRUCTURAL LOCK FOR TILTING-TYPE DOUBLE HUNG WINDOWS

This is a continuation of application Ser. No. 08/164,369, filed Dec. 9, 1993, now abandoned.

FIELD OF THE INVENTION

The present invention is directed to a structural lock mechanism for use in tilting-type double hung windows, and in particular, a lock mechanism which is automatically brought into engagement when the window sash is in the closed position so that the window sash is rigidly connected to the window jamb.

BACKGROUND OF THE INVENTION

Tilting-type double hung windows allow the individual window sash to be tilted inward for purposes of cleaning. While this feature is extremely convenient, a window sash which can be tiltably disengaged from the window jamb may not be capable of withstanding wind loading normally encountered in high rise buildings.

The lock structures on double hung windows typically connect only the upper and lower window sash to each other, rather than to the window jamb. High wind loads may also cause the window jamb to partially separate from the window frames, allowing outside air into the building. Finally, the anti-tilting locks provided on tilting-type double hung windows provide only limited security against forced entry.

U.S. Pat. No. 4,521,991 issued to Sayer et al. on Jun. 11, 1985, discloses a locking member which is inserted between the window sash and the window jamb to provide additional structural strength to a tilting-type double hung window. The locking mechanism of Sayer requires a customized jamb liner and window sash structure to operate the locking mechanism. The elongated locking member must be removed from the channels between the window sash and the window jamb before the window sash can be tilted inward. During normal operations with the locking member in place, the window cannot be tilted inward. Finally, the locking member provides additional friction to opening and closing the window.

SUMMARY OF THE INVENTION

The present invention is directed to a structural lock mechanism for tilting-type double hung windows which automatically engages when the window sash is in the closed position so as to provide rigid engagement between the window sash and the window jamb, and which disengages when the window sash is opened.

The structural lock member comprising a first and second locking mechanism constructed and arranged for automatically interlockably engaging when the sash is in the closed position and disengaging when the sash is in the opened position.

The window sash is preferably capable of pivoting with respect to the window jamb when the window sash is in the opened position. The structural lock member prevents the window sash from pivoting when the window sash is in the closed position.

The first locking mechanism preferably comprises a strap member having a locking portion and a mounting portion, where the locking portion is wider than the mounting portion. The second locking mechanism comprises an elongated "C" shaped member.

Alternatively, the first or second locking mechanisms may be formed in the jamb liner or sash.

The first and second locking mechanisms are preferably constructed of metal or some other high strength material which can withstand high loads.

In the preferred embodiment, the structural lock mechanism includes a sliding lock mounted in the channel of at least one of the side members of the window sash. A mating strap mechanism is mounted in the adjacent channel of the window jamb and is positioned so that the sliding lock and strap mechanism are in rigid engagement when the window sash is in the closed position. The sliding lock and strap mechanism disengage when the window is moved to the open position, allowing the window sash to be tilted inward for cleaning.

The sliding lock includes a number of load-bearing surfaces for restricting the movement of the window sash relative to the window jamb in several directions or degrees of freedom.

The structural lock of the present invention is only engaged when the window sash is in the closed position so that it does not inhibit movement of the window sash within the window jamb.

When the window sash is in the closed position, the structural lock provides additional security against forced entry.

DETAILED DESCRIPTION OF THE PREFERRED EMBODIMENT

Figure 1:
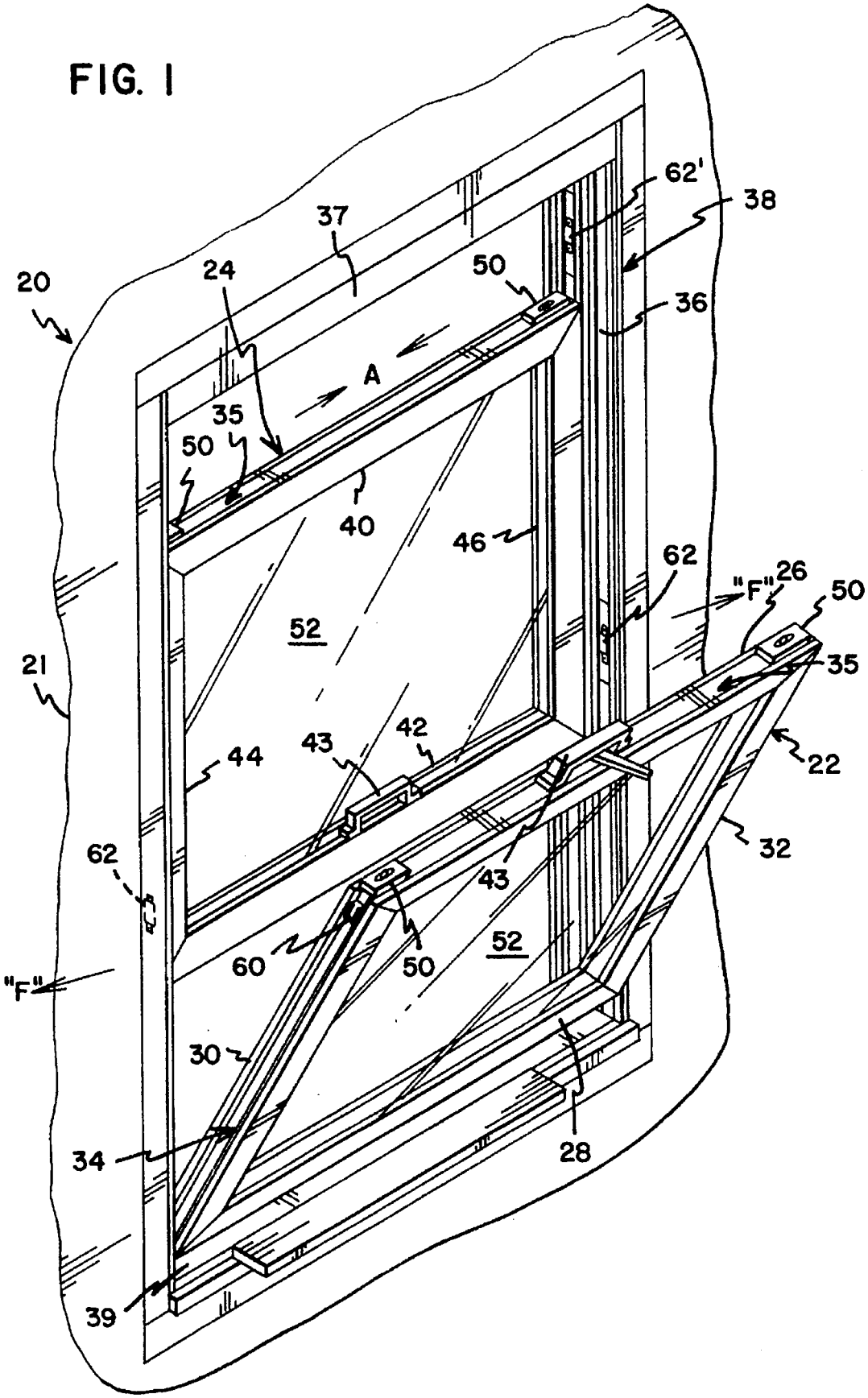
FIG. 1 is a perspective view of a tilting-type double hung window utilizing the structural lock mechanism of the present invention.

FIG. 1 illustrates a conventional tilting-type double hung window 20 mounted in a wall structure 21 having a lower window sash 22 in a tilted position and an upper window sash 24 in a partially open position. The lower window sash 22 has an upper rail 26, a lower rail 28 and a pair of stiles 30,32 with channels 34 for engaging complementary channels 36 in a jamb liner 38 (see FIG. 3). The upper window sash 24 has an upper rail 40, a lower rail 42 and a pair of stiles 44,46 with channels (not shown) for engaging channels 36 in a jamb liner 38. Each window sash 22,24 contains a pane of glass 52 attached to the window sash 22,24 by conventional methods.

While FIG. 1 discloses a double hung window having sashes which move vertically, it will be understood by those skilled in the art that the present structural lock mechanism may be used on windows that move horizontally as well. Moreover, the claimed invention is not limited to rectangular windows, but may be used on windows of any shape which move within a jamb liner structure.

The jamb liner 38 preferably has channels in its top edge 37 and bottom edge 39 for engaging with complementary channels 35 on the upper and lower rails 26,28,40,42 when the upper and lower sash 22,24 are in fully opened or closed positions. Additionally, a two-piece lock mechanism 43 is attached to stiles 26 and 42 for releasably attaching the lower sash 22 to the upper sash 24.

It is intended that the present invention is applicable to a variety of window structures and other closures. It will be understood to those skilled in the art that the window 20 discussed herein represents only one type of window with which the present structural lock may be used. For example, the channels on the window sash 22,24 and window jamb 38 may be located in a horizontal rather than a vertical orientation.

Tilt locks 50 are generally provided on the outside edges of upper rails 26,40 for engaging with the channels 36 in the jamb liner 38. The tilt locks 50 retain the window sash 22,24 in the jamb liner 38 during normal window operations. The tilt locks 50 preferably slide inward in a direction "A" so that the window sash 22,24 can be disengaged from the channels 36 in the jamb liner 38, allowing the window sash 22,24 to be tilted inward.

Figure 2:
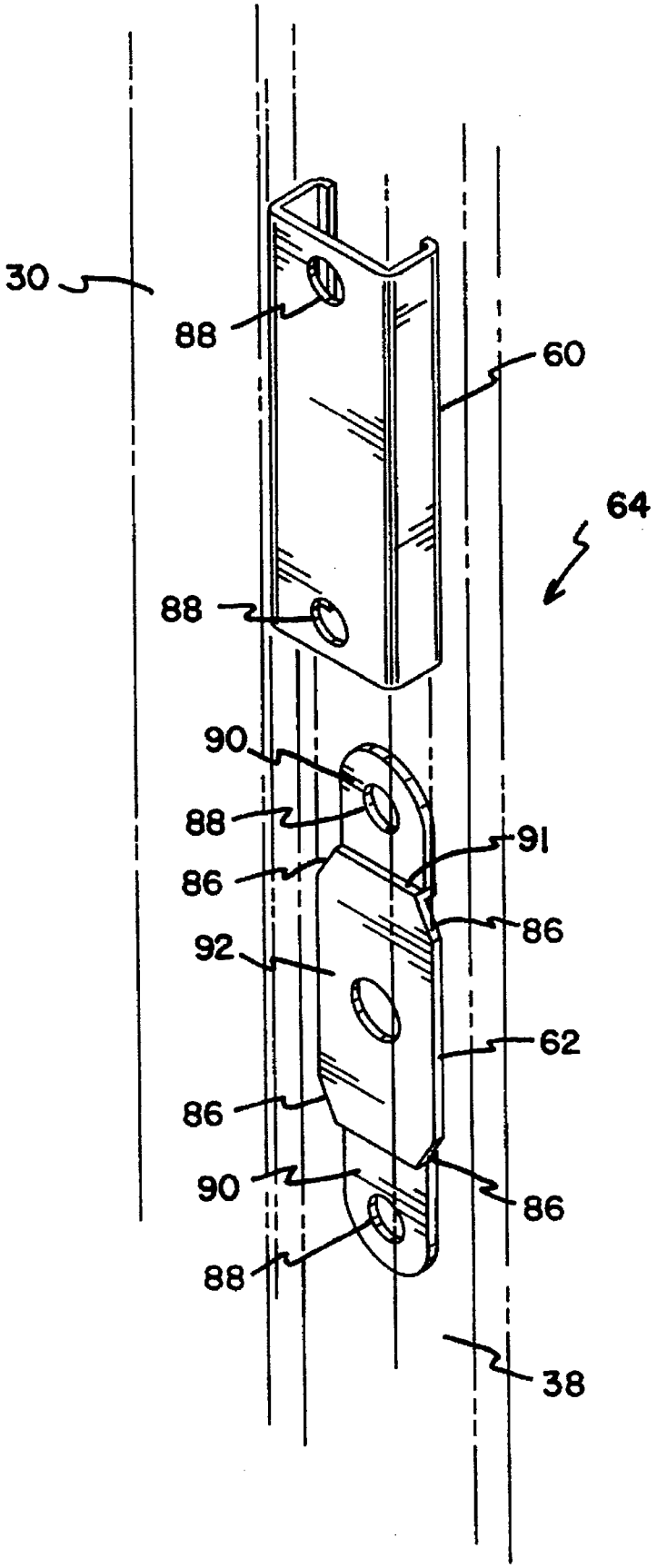
FIG. 2 is a exploded view of the structural lock.

FIG. 2 illustrates an exploded view of structural lock 64, including a sliding lock 60 attached to the side sash 30 engaging with a strap 62 on the window jamb 38. The strap 62 preferably has upper and lower mounting portions 90, each with at least one mounting hole 88, and a locking portion 92 which is wider than the mounting portions 90. The locking portion 92 is preferably parallel to, but offset from, the mounting portions 90 by an off-setting member 91 so that the locking portion 92 is raised above the jamb channel 36. The narrower mounting portions 90 are preferably sized to fit into the channel 36 on the window jamb 38. It will be understood that it is not necessary in all circumstances for the mounting portion 90 to be narrower than the locking portion 92 as long as the off-setting member 91 is narrower than the locking portion 92.

The sliding lock 60 has a C-shaped cross section which allows it to slidably engage with the raised locking portion 92 on the strap 62. The locking portion 92 preferably has beveled edges 86 to facilitate engagement and disengagement with the sliding lock 60.

In the preferred embodiment illustrated in FIG. 1, the sliding lock 60 is preferably mounted in the channels 34 of stiles 30,32 proximate the upper rail 26. A pair of sliding locks 60 are also preferably mounted in the channels of the upper window sash 24 (not shown). The strap 62 is preferably located so that it is engaged with the sliding lock 60 when the window sash 22 is in the fully closed position. While the sliding lock 60 and strap 62 are preferably constructed of metal or plastic, it will be understood that a variety of materials have sufficient strength to be suitable for this application. In an alternate embodiment, the sliding lock or strap may be formed directly in the sash or jam liner, respectively.

By sliding the lower window frame 22 slightly upward, the sliding lock 60 disengages from the straps 62 and allows the lower window sash 22 to be tilted inward. Likewise, by sliding the upper window sash 24 downward slightly, the sliding lock (not shown) disengages from the strap 62' so that the window upper sash 24 can be tilted inward for cleaning. The locking portion 92 of the strap 62 is preferably 0.5" long so that the window sash 22,24 need only be opened a short distance to disengage the structural lock 64.

Figure 3:
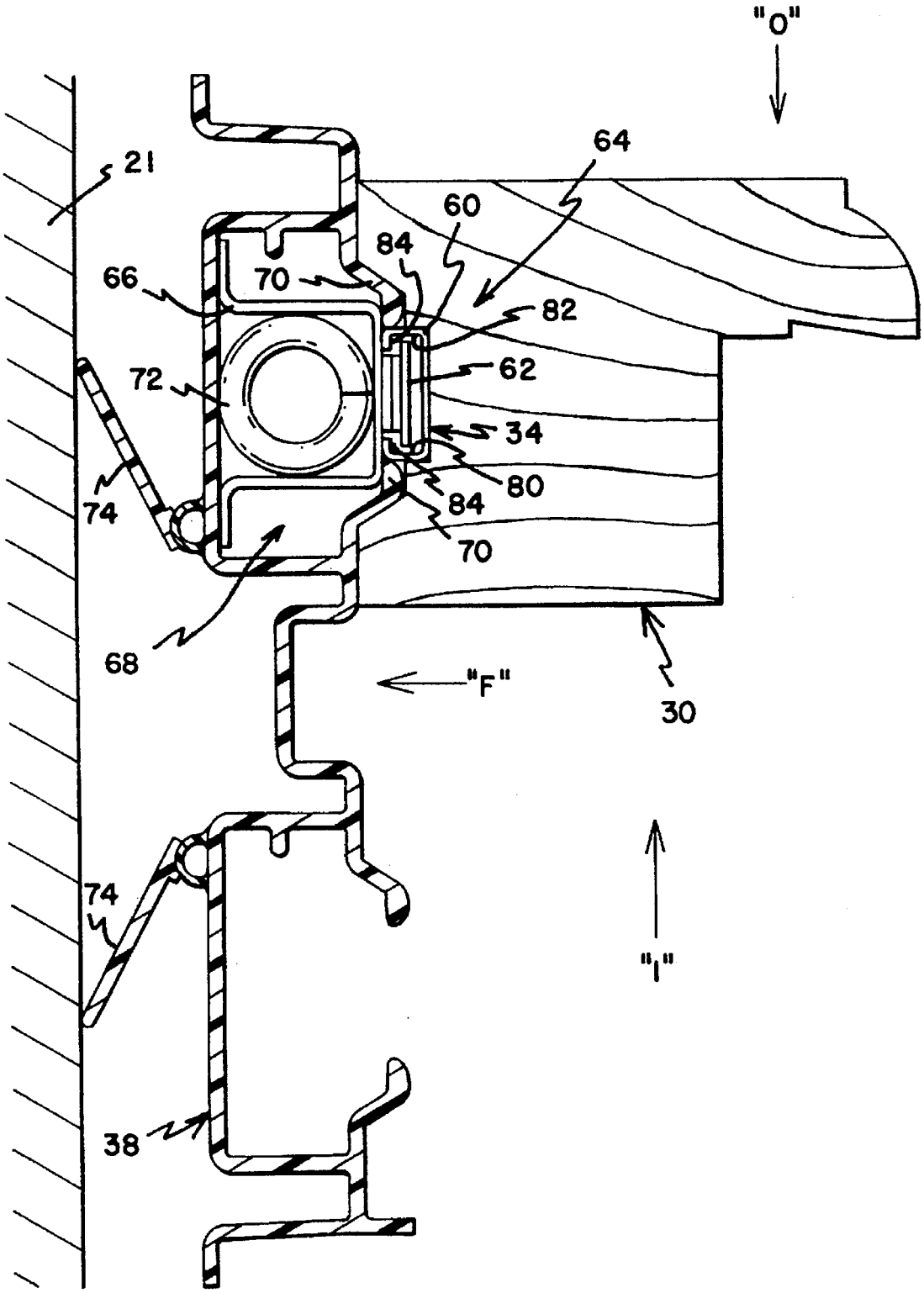
FIG. 3 is a sectional view of a window jamb with the window sash in the closed position so that the structural lock is engaged.

FIG. 3 illustrates a sectional view of the jamb liner 38 and the stile 30 located in a position so that the structural lock 64 is engaged. Protrusions 70 on jamb liner 38 engage with the channel 34 on the stile 30 of sash 22. The sliding lock 60 is mounted in the channel 34 in the stile 30. In the preferred embodiment, the strap 62 is attached to a block and tackle tube 66 which is located in a cavity 68 formed between the protrusions 70 on the jamb liner 38. Alternatively, the strap 62 may be integrally formed in the block and tackle tube 66. For example, the strap 62 may be stamped into the tube 66 during manufacture. The block and tackle tube 66 preferably contains a spring mechanism 72 for retaining the window sash 22 at the desired height. It will be understood that a variety of mechanisms are available for retaining the windows to the desired position.

The jamb liner 38 preferably flexes inward in a direction "F" to allow the channels 34,48 on the stiles 30,32,44,46 of window sash 22,24 to disengage from the jamb liner 38. A pair of tabs 74 on the jamb liner 38 preferably abut the wall structure 21, allowing the jamb liner 38 to flex sufficiently so that the channel 34 on the window sash 22 can disengage from the protrusions 70 on the jamb liner 38.

The C-shaped cross section of the sliding lock 60 has a number of load-bearing surfaces which wrap around the locking portion 92 of the strap 62 to restrict movement of the window sash 22,24 in several directions or degrees of freedom. A first bearing surface 80 resists inward forces "T" caused by wind loads. The second bearing surface 82 resists outward forces "O" which can be created by a positive pressure differential from the inside to the outside of the window 20.

Under some circumstances, wind forces can be sufficiently great to overcome the resistance provided by the tabs 74 and cause the jamb liner 38 to flex inward, thereby separating the jamb liner 38 from the window sash 22. Third bearing surfaces 84 on the sliding lock 60 rigidly retains the jamb liner 38 against the channel 34 on the stile 30 of the window frames 22.

Because the structural lock 64 of the present invention has a low profile, it may be possible in some circumstances to utilize the structural lock mechanism 64 with existing window frame and jamb liner designs.

It will be understood by those skilled in the art that the present inventions are not limited to the examples discussed above, but may be changed or modified without departing from the spirit or scope of the invention. For example, variations in the sliding lock and strap configurations are possible. Additionally, it is possible to mount the sliding lock on the jamb liner and the strap on the side sash of the window frame.

What is claimed is:

1. A structural lock mechanism for a window sash having longitudinal channels which slide in complementary channels in a window jamb between open and closed positions, the window sash being capable of pivotal tilting movement relative to the window jamb, the structural lock mechanism comprising:

first locking means mounted to said window sash for movement therewith, the first locking means comprising a first locking member that projects toward said window jamb and is stationary relative to the window sash; and second locking means mounted to the window jamb in a stationary position, the second locking means comprising a second locking member that projects toward said window sash and is stationary relative to the window jamb;

the first and second locking means being constructed and disposed so that when the window sash is moved to the closed position the first and second locking members passively enter into mutually opposed, laterally abutting relation while remaining stationary relative to the associated window sash and window jamb to which each is mounted to prevent the window sash from being pivotally tilted from said closed position and to passively leave said laterally abutting relation when the sash is moved from the closed position to an open position.

2. The apparatus of claim 1 wherein the first locking means comprises a strap member having a locking portion and a mounting portion.

3. The apparatus of claim 1 wherein the first locking means is integrally formed in the window jamb.

4. The apparatus of claim 2 wherein the locking portion is off-set from the mounting portion.

5. The apparatus of claim 1 wherein the second locking means comprises an elongated C-shaped member.

6. The apparatus of claim 1 wherein the first or second locking means are constructed of metal.

7. The apparatus of claim 1 wherein the first or second locking means are constructed of a structurally sound material.

8. The apparatus of claim 1 wherein the window sash is square.

9. The apparatus of claim 1 wherein the window sash is rectangular.

10. The apparatus of claim 1 wherein the first locking means includes at least three load bearing surfaces for engagement with the second locking member when the window sash is in the closed position.

11. A structural lock mechanism for a window sash having longitudinal channels which slide in complementary channels in a window jamb between an opened and a closed position, the window sash being capable of pivotal tilting movement relative to the window jamb, the structural lock mechanism comprising:

first locking means mounted to said window sash for movement therewith, said first locking means being disposed in opposition to the window jamb and comprising a strap member having a locking portion and a mounting portion;

second locking means mounted to the window jamb in a stationary position and disposed to be slidably engaged by the first locking means as said window sash is moved into said closed position;

said first and second locking means being constructed and arranged for automatic interlockable engagement as the sash enters the closed position, and for automatic disengagement when the sash is moved from said closed position to an open position, and said first and second locking means cooperating to rigidly connect the sash to the window jamb when the sash is in the closed position and to prevent it from being pivotally tilted therefrom.

12. A structural lock mechanism for a window sash having longitudinal channels which slide in complementary channels in a stationary window jamb between an open and a closed position, the window sash being capable of pivotal tilting movement relative to the window jamb, the structural lock mechanism comprising:

first locking means mounted to one of the movable sash and stationary jamb and comprising a strap with a mounting portion and a locking portion, the locking portion being offset and spaced from the mounting portion;

and second locking means mountable to the other of the movable sash and stationary jamb, the second locking means comprising a C-shaped member sized to fit over and interlockably engage the locking portion of the strap when the sash is moved to the closed position to prevent the sash from pivotally tilting in said closed position.

13. The structural lock mechanism defined by claim 12, wherein the strap is mounted to the jamb and the C-shaped member is mounted to the side of the sash.

14. The structural lock mechanism defined by claim 12, wherein the strap comprises first and second end portions which together define the mounting portion, said first and second end portions being disposed substantially in a first plane, and said locking portion is disposed intermediate said first and second ends and disposed in a second plane substantially parallel to said first plane.

15. The locking mechanism defined by claim 14, wherein the locking portion of the strap is of predetermined width, and the C-shaped member is of slightly greater internal width to permit relative slidable, interlocking movement with the locking portion of said strap.

16. The locking mechanism defined by claim 15, wherein the locking portion of the strap is connected to and spaced from said mounting portion by first and second offsetting members respectively disposed at the ends thereof, the offsetting members being narrower than the locking portion of the strap.

17. A structural lock mechanism for a window sash having longitudinal channels which slide in complementary channels in a window jamb between open and closed positions, the window sash being capable of pivotal tilting movement relative to the window jamb, the structural lock mechanism comprising:

first locking means mounted to the window sash for movement therewith, the first locking means comprising a first locking member that is stationary relative to the window sash;

and second locking means mounted to the window jamb in a stationary position the second locking means comprising a second locking member that is stationary relative to the window jamb;

the first and second locking means being constructed and arranged to passively enter into interlockable engagement when the sash is moved into the closed position, and to passively leave said interlockable engagement when the sash is moved from the closed position to an open position, and said first and second locking members interlockably cooperating when the sash is in said closed position to prevent it from being pivotally tilted therefrom.

18. The structural lock mechanism defined by claim 17, wherein the first locking members comprises a strap member having a locking portion and a mounting portion.

19. The structural lock mechanism defined by claim 18, wherein the locking portion is offset from the mounting portion.

20. The structural lock mechanism defined by claim 17, wherein the first locking means is integrally formed in the window jamb.

21. The structural lock mechanism defined by claim 17, wherein the second locking means comprises an elongated C-shaped member.

* * * * *